United States Patent [19]

Adams

[11] 4,144,088

[45] Mar. 13, 1979

[54] PROCESS OF RECLAIMING USED FOUNDRY SAND

[75] Inventor: Willard L. Adams, Muskego, Wis.

[73] Assignee: Kenzler Engineering Company, Inc., Milwaukee, Wis.

[21] Appl. No.: 760,533

[22] Filed: Jan. 19, 1977

[51] Int. Cl.[2] ..... B08B 7/02; B08B 7/04

[52] U.S. Cl. ..... 134/2; 134/17; 134/18; 134/19; 134/25 R; 164/5

[58] Field of Search ..... 134/2, 17, 18, 19, 20, 134/25 R; 164/5; 241/DIG. 10; 209/3

[56] References Cited

U.S. PATENT DOCUMENTS

| | | | |
|---|---|---|---|
| 1,587,621 | 6/1926 | Walther | 241/DIG. 10 X |
| 2,331,102 | 10/1943 | Bird | 209/17 |
| 2,478,461 | 8/1949 | Connolly | 134/2 X |
| 2,813,318 | 11/1957 | Horth | 164/5 X |
| 3,358,380 | 12/1967 | Murphy | 164/5 X |
| 3,764,078 | 10/1973 | Richard | 241/DIG. 10 X |

FOREIGN PATENT DOCUMENTS

| | | | |
|---|---|---|---|
| 2429169 | 1/1976 | Fed. Rep. of Germany | 164/5 |
| 2451494 | 5/1976 | Fed. Rep. of Germany | 164/5 |

*Primary Examiner*—Marc L. Caroff

*Attorney, Agent, or Firm*—James E. Nilles

[57] ABSTRACT

Used foundry sand is reclaimed by crushing the sand and separating both metallic material and at least a portion of the unwanted non-metallic portion of the sand, then heating the sand to a temperature of about 1400° F. for burning off the foreign material and causing the sand particles to pass through a strong expansion phase somewhere above 1000° F. and passing through a contractual phase at a higher temperature to thereby cause the foreign material to be cracked or otherwise parted from the particles and the sand particles become increasingly thermally stable from subsequent reuse as clean sand. The heated sand is then cooled to about 400°-500° F. The process includes the utilization of some of the heat of the thermal furnace for a shell coating operation. The process also includes classifying the cooled sand as to size particles and then taking the agglomerated coarser particles and subjecting them to further cooling and a sand scrubbing operation for further reduction to particle size. The reduced and cleaned sand is combined with new sand as may be required to meet screen specifications. The sand mixtures may then be used as a replacement for new sand. They may also be blended, heated, and coated with bonding materials for reuse.

6 Claims, 3 Drawing Figures

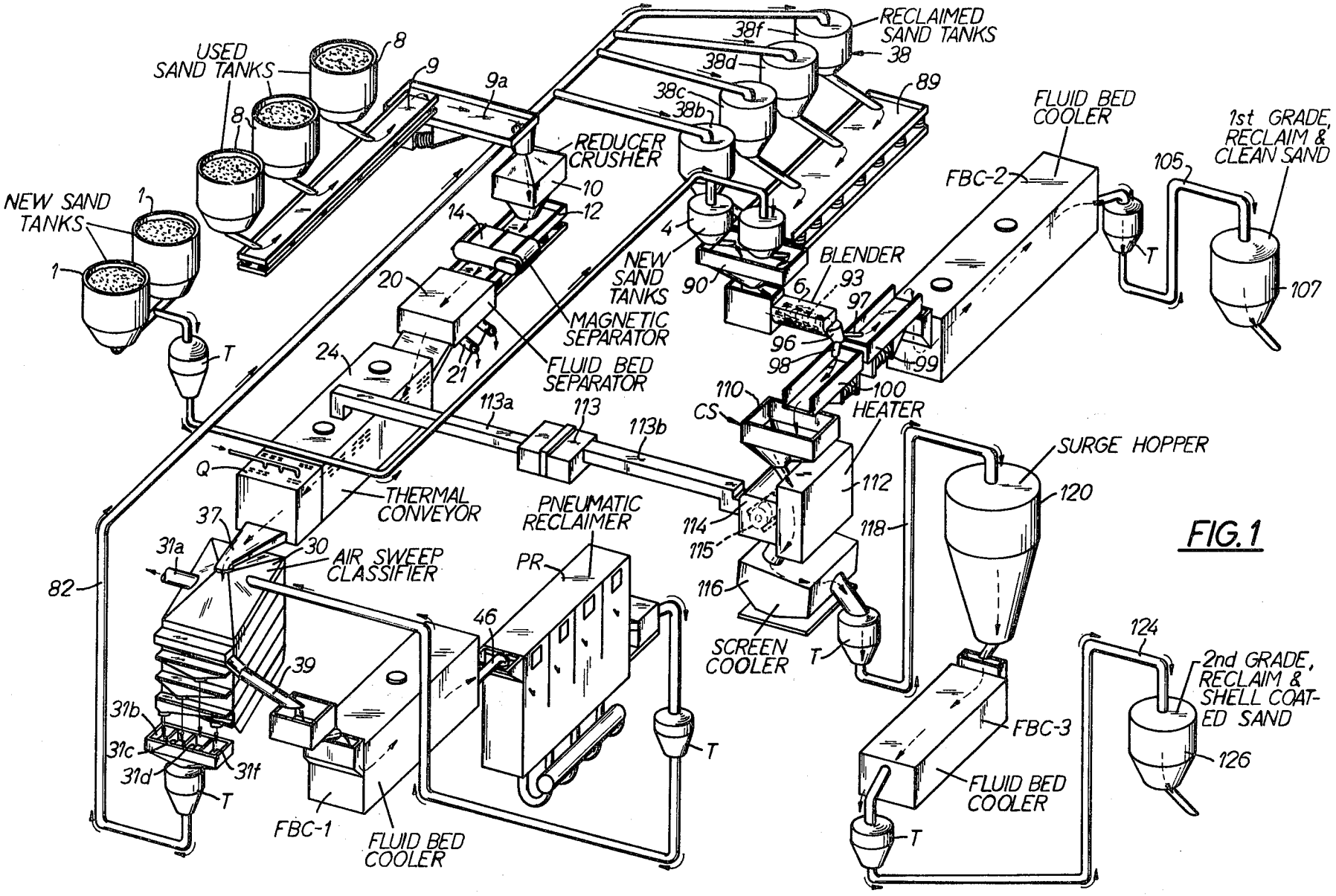
1st GRADE, RECLAIM & CLEAN SAND
107
105
T
FLUID BED COOLER
FBC-2
RECLAIMED SAND TANKS
38
89
38f
38d
38c
38b
REDUCER CRUSHER
10
12
9a
9
8
USED SAND TANKS
NEW SAND TANKS
1
BLENDER
93
97
6
96
98
99
100
90
4
14
MAGNETIC SEPARATOR
FLUID BED SEPARATOR
21
20
24
SURGE HOPPER
120
HEATER
112
110
CS
113b
113
113a
THERMAL CONVEYOR
Q
30
37
31a
AIR SWEEP CLASSIFIER
39
31f
31b
31c
31d
118
114
115
116
SCREEN COOLER
PNEUMATIC RECLAIMER
PR
46
FBC-1
FLUID BED COOLER
82
FIG. 1
2nd GRADE, RECLAIM & SHELL COATED SAND
126
124
FBC-3
FLUID BED COOLER

PROCESS OF RECLAIMING USED FOUNDRY SAND

BACKGROUND OF THE INVENTION

The invention pertains to a process for reclaiming used foundry sand such as of the type having a shell coating of resin or other material thereon and which contains other impurities. Such a process in general includes reducing the sand by crushing for example, and separating the magnetic material from the sand by the use of a magnetic separator and also separating non-metallic material from the crushed sand by means of a fluid bed separator or the like. These conventional processes also include the heating of the sand and classification of the sand particles as to size. Examples of the prior art of the type over which the present invention is an improvement are shown in the U.S. Pat. No. 2,478,461 which issued Aug. 9, 1969 and entitled "Apparatus and Method for Treating Foundry Sand." The furnace shown in that patent is of the multiple hearth, rabbling "roaster" type which operates at high cost and high maintenance; the scrubbing chamber is expensive and utilizes air scrubbing. U.S. Pat. No. 2,261,947 which issued Nov. 11, 1941 entitled "Foundry Practice" utilizes a wet scrubbing method in which silica sand, water slurry casting cleaning is utilized.

SUMMARY OF THE INVENTION

The present invention provides a process for reclaiming used foundry sand and which includes the steps of reducing the sand, separating magnetic material therefrom, separating a portion of the non-metallic material therefrom if required or desirable, and then heating the sand so treated. The heating phase includes raising the temperature of the sand to about 1400° F. which acts to first cause the sand particles to expand and then causes the sand particles to rapidly contract thereby causing foreign material to be separated from the sand particles and causing the sand particles themselves to become more stable due to the expansion—contraction process. During the heating process, the foreign material in the sand, such as resins, carbonaceous material, or other foreign matter is used to supply a portion of the heat for this heating process. The heated, stabilized sand is then quickly cooled after leaving the furnace to approximately 400°-500° F. where it is then classified according to grain size and air swept to remove the dust therefrom. The various grades of fine sand are then conducted to separate classification bins but the coarse agglomerated sand which does not pass through these appropriate screens is further cooled and passes through a sand scrubber for further reduction of the agglomerate to grain size and cleaning of the grains. The scrubbed grain is then conveyed back to the air sweep classifier and upon passing the proper screen size is also conducted to the classification bins. New sand is then combined with the reclaimed sand, if required, blended, and then may be passed through a coating station where it is heated and coated with a shell of bonding material. One aspect of the present invention contemplates the use of the heat of the furnace to heat the sand at the coating station, thus contributing to an efficient process. The coated sand is then further cooled and the resulting, stabilized sand is reuseable in the foundry process. Those reclaimed sand mixtures not coated are improved and reuseable in any foundry requirement for new clean sand.

The process of the present invention provides a stabilized sand which markedly reduces casting scrap, due to the expansion defects which are normally encountered in silica sand molding operations and the present invention also insures measurable improvement in dimensional accuracy and reproductability in the foundry process due to improved sand stability.

These and other objects and advantages of the present invention will appear hereinafter as this disclosure progresses, reference being had to the accompanying drawings.

BRIEF DESCRIPTION OF THE DRAWINGS

FIG. 1 is a perspective, schematic view of the apparatus with which the present process is practiced;

FIG. 3 is a graph showing the effects of the heating and rapid cooling on the sand grain size.

DESCRIPTION OF A PREFERRED EMBODIMENT

Figure 2:
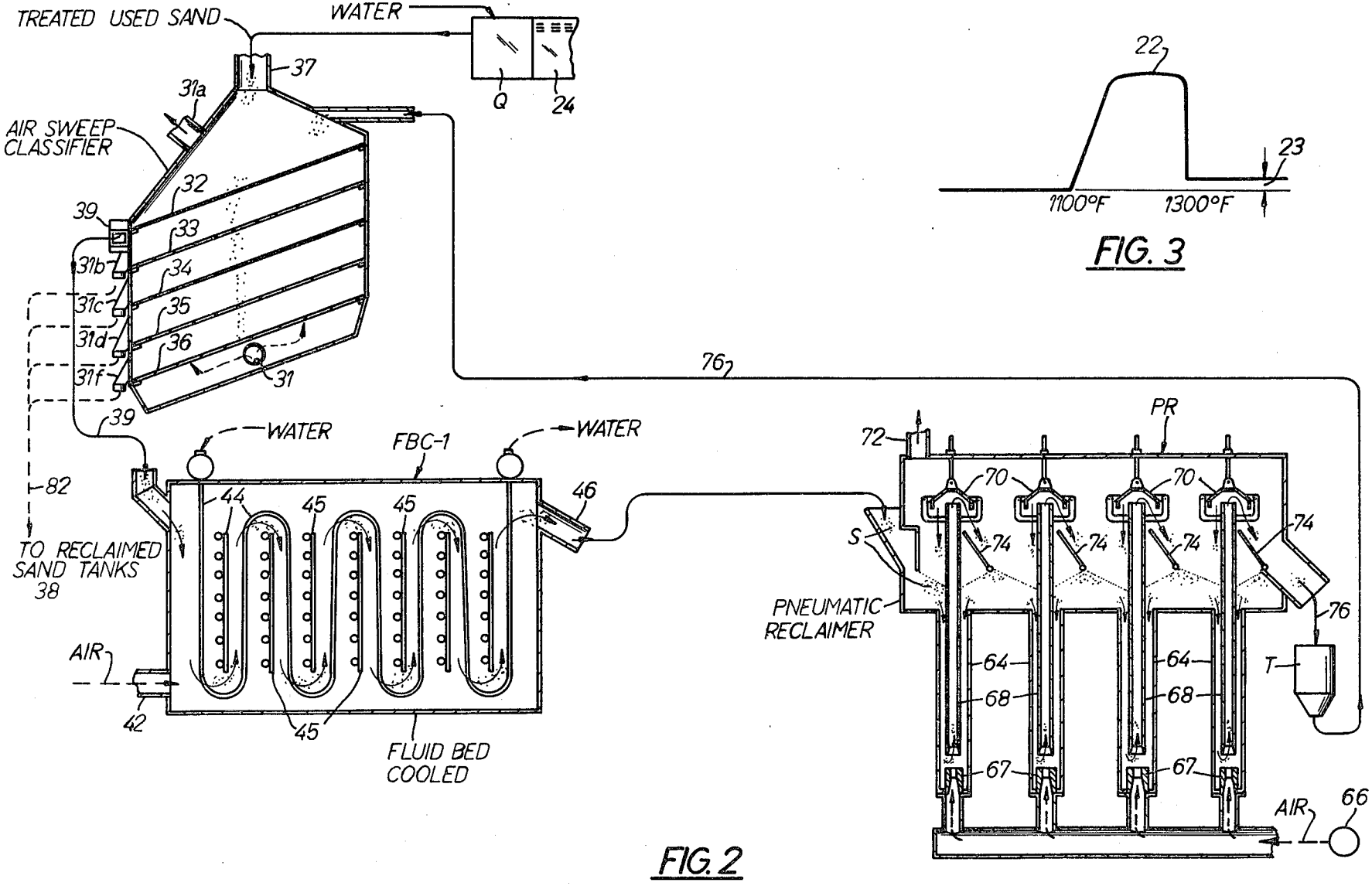
FIG. 2 is a sectional view through portions of the components shown in FIG. 1.

The present invention provides a process for reclaiming used foundry sand and combining it with new sand to meet specifications. The resulting sand mixture may then be coated with a bonding material such as resin. During the process, the reclaimed sand is stabilized as to its size so that upon reuse in the foundry it does not appreciably change its grain size and consequently will not cause casting defects which are generally referred to as "expansion defects." Each time the silica sand passes through the phasing process where it is expanded and quickly contracted, the subsequent amount of expansion and the severity thereof decreases. The present invention provides an economical and efficient process for reclaiming used foundry sand and provides a finished, blended sand which is particularly stable for subsequent foundry uses. In addition, the reclaimed sand provided by the present invention and which has been thermally reclaimed provides sand grains of sufficient similar size and screen analysis which requires considerably less bonding material to achieve proper molding strengths. The process provided by the present invention will be described in connection with certain sand handling and treating components, many of which are conventional in nature. The operation order or sequence of operation of these various components will now be referred to in greater detail. Reference will be made to "new sand" which means sand that has not been used for foundry purposes but rather is unused.

New sand is stored in conventional hoppers or bins 1 and conveyed by the transporter T via line 3 to the new sand tanks 4 which deposit new sand in the blender 6.

The present system utilizes several transporters T for transporting the sand from one station to the other via suitable conduits. These transporters are of themselves conventional and it is believed sufficient to say that they are of the dense phase air type so that the sand is conveyed pneumatically at low velocity by air under pressure which is introduced into the transporter. These transporters may be of the type manufactured by Dynamic Air Incorporated of St. Paul, Minn.

Reducing

Used sand which is to be reclaimed is deposited and held in the storage bin or tanks 8 and is then discharged as required onto the conveyor means 9 for delivery into a reducer lump crusher 10. The reducer lump crusher is of the ortibal rotating type and acts to break up or reduce the clumps of used sand and then deposits the loose sand on a conventional conveyor 12.

In the present systems, several conventional vibratory, spring mounted conveyors 9, 9a, 12, 89, 99 and 100 are used and they all are of the same type, and are not believed to require any detailed explanation.

Magnetic Separating

The conveyor 12 conveys the reduced sand beneath a magnetic separator 14. The magnetic separator may be of the endless belt type which contains magnets that pass over the reduced sand and pick up tramp metal, rods, nut, bolts, and other metallic materials from the sand and then discharges the metal, in the known manner, to one side of and separate from the conveyor 12.

Non-Metallic Separating

The iron free, crushed sand then passes through a fluid bed (air) separator 20 which removes the non-metallic foreign matter from the sand by floating the foreign matter and separating it, by a series of inclined screens, from the heavier sand grains, and discharging the foreign matter to the side, via outlet 21. It is believed sufficient to say that the fluid bed separator is of the multi-screen type that separates the non-metallic material by weight. That is the solids are suspended by the screens and within an upward moving stream of gas and the solids/gaseous mixture behaves like a liquid which can be handled, measured and controlled as though it were a liquid.

Heating

Upon leaving the fluid bed separator, the sand enters a furnace or thermal conveyor 24 which may be fired by coal, gas, oil, or the like. The furnace heats the sand and its foreign material such as clay, carbonaceous material, and other non-metallic foreign matter to a temperature preferably of about 1400° F. As the material is being conveyed through the furnace, the carbonaceous material and some of the other foreign material is burned off. The heating of the sand grains causes them to change size thereby further causing the foreign material, to a certain extent, to be cracked or removed from the grain of sand.

The sand, when it reaches a temperature of about 1100° F., greatly expands, as shown in the graph of FIG. 3. The expansion process then levels off as shown in the portion 22 of the curve and upon reaching a temperature of about 1300° F., the sand contracts markedly. However, the sand does not contract back to the original volume and the differential 23 is a stabilized point of sand particle size. Thus, the heating process to which the sand is submitted, and mainly of about 1400° F. acts to cause the sand to severely increase causing a further contribution to the breaking off of the foreign material, such as the clay and carbonaceous material. Once the sand has been so stablized by this heating process, it remains more stable in future heat cycles, that is to say, it expands less after each process treatment.

The thermal reclamation of foundry sand requires only relatively minor quantities of fuel because the impurities in the waste sand act as fuel to sustain the required combustion, for example these waste by-products in the sand are in the form of oils, resins, coals, pitches, and cellulose fibers of various types and these materials are the principal contaminants which are being claimed from the sand. Thus, the impurities have a high thermal value and the heating is a self-generating process that keeps the degree of heat up to sufficient levels in the furnace.

Air Sweep Classifier

After leaving the furnace 24, the hot sand is quickly cooled to about 400–500 degrees F., in a water quencher Q. This further cooling, also helps break up coatings of foreign material remaining on the sand grains.

The sand is then delivered via conduit 37 to the air sweep classifier 30 shown in FIGS. 1 and 2. The air sweep classifier 30 has an air inlet 31 which directs the air upwardly through the grading screens 32, 33, 34, 35 and 36 and the dust ladened air is discharged through outlet 31a. The air sweeps the sand, causing it to be tossed about for good contact with the screens. The heated sand is conveyed on the inclined, first course screen 32 and the large sand grains are delivered to the conduit 39 where it is conducted to the fluid bed cooler FBC-1. A portion of the sand which passes through the first screen 32 is small enough and has had its impurities and coatings sufficiently removed by the previous crushing, magnetic separation, fluid bed separation (non-metallic separation), and heating processes, so that it is acceptable and consequently passes into the conduit 82 where it is conducted to the reclaimed sand tanks 38.

Various receiving compartments 31b, 31c, 31d, and 31f are provided for receiving the various grades of sand from the screens of the classifier. These various grades are then selectively conveyed by conduit 82 to their respective tanks 38b, 38c, 38d, and 38f, where the desired grades are drawn off for blending with new sand as may be required.

As the sand passes through the air sweep classifier, it is further cooled somewhat and upon leaving the classifier via conduit 39, it is at a temperature of about 450° F.

That portion of the sand, which because of its large size passes directly to the fluid bed cooler FBC-1, is then treated by being conveyed by air entering the inlet 42 and over the cooling water tubes 44 and over and under the various baffles 45 in the cooler to further reduce the sand and cool it to about 300° F.

The present system utilizes a number of fluid bed coolers FBC-1, FBC-2, and FBC-3, through which the sand is conveyed from one end to the other. These fluid bed coolers are of the type having a system of water coils 44 which act as heat exchangers and provide multiple weirs over which the sand mixed in the fluid bed (air bed) is forced over. The water coil 44 receives recirculating water from a cooling tower (not shown). Fluidized air is provided by a turbo-compressor (not shown). The cooled sand then passes to the outlet 46.

Pneumatic Reclaimer-(Sand Scrubber)

After the sand has been reconditioned to some extent by the previously described reducer crusher, the magnetic separator, fluid bed separator, thermal conveyor, and the screening process provided by the air sweep classifier, all of which treat the sand as a mass, the compound grains and the accumulated coatings of burned clay and carbonaceous material respond to only more intensive treatment of the individual sand grains. Wet processing and thermal reclamation methods, when combined, are effective but economically impractical except for very large high volume operations.

In other words, during the thermal destruction of resins, pitches, wood products, coal and oils in the sands, certain of these residues combined with clays will form a coke-like matrix in which several individual sand grains may be trapped. In a normal screening, these agglomerates could easily retain their indentity and present a false specification. Of equal importance, the coke-like material is a "sponge" thirsty material which would greatly decrease the value of the product.

A grain of sand may be coated with layers of clay and carbonaceous material, for example, the original grain may have a first layer of vitrified clay and carbonaceous material and also a second layer of similar material, both layers of which in addition also contain fines and live clays. Thus, sand of this character which is referred to as a waste shake-out sand, even after the previously mentioned "reconditioning" cannot continuously be reused for facing and cores. The grains become roughened, fused and enlarged. Excessive fines and size variations of the grains reduce response to ramming, making sand hard to control and thermally unstable.

Consequently, after the partially reconditioned sand leaves the air classifier 30, it is passed through a fluid bed cooler FBC-1 and into a pneumatic reclaimer PR shown in FIGS. 1 and 2. The pneumatic reclaimer (or sand scrubber) combines the performance of the thermal and wet systems of reconditioning into a single compact unit. The pneumatic reclaimer PR utilizes air as the motivating force and uses the sand grains themselves as the abrasive body.

The pneumatic reclaimer PR comprises a number of scrubbing cells 64 having a turbine type blower 66 that supplies compressed air to a nozzle 67 of each of the cells. The nozzle accelerates both the air and the sand S upwardly through a blast tube 68 to the proper scrubbing velocity depending on the type of sand to be reclaimed. The sand grains are impacted against sand grains which are already trapped within a conical target 70. The intensive scrubbing action separates fused grains, clusters, and strips of carbonaceous matter and spent clay. The spent material and fines are carried off at conduit 72 to a dust collector (not shown).

The pneumatic reclaimer PR is gravity fed and the adjustable deflector plates 74 control the rate of reclamation by the rate of flow of one cell to the next. Air velocity is controlled by adjusting the spacing between the nozzle 67 and the air tube 68. The treated sand is repeatedly circulated, part of which being continuously diverted to the next cell via the deflector plate 74 where the process is repeated. Upon leaving the last cell, the treated sand is returned via line 76 to the upper chamber of the air sweep classifier 30. This sand then passes through the sieves 32, 35, and 36 and out of their respective outlets where they are deposited in the compartments 31*b*–31*f*, for subsequent delivery by conduit 82 to the reclaimed sand tanks 38.

The reclaimed sand in any one of the tanks 36*c*–36*d* may be combined with new sand from tanks 1, the latter of which is conveyed by conduit 3 into tanks 4, such combining taking place in a blender 6. From the blender, the blended sand is then either delivered to a first storage tank, as will appear, where it can be used as reclaimed and clean sand. Alternatively, the sand from the blender, as will appear, is diverted to a coating station for subsequent treatment and which results in a second grade of sand namely a reclaimed and bond coated sand, as will presently be described.

Blending

The reclaimed sand from tanks 38 is delivered by a vibratory conveyor 89 to a hopper 90 located above the blender 6. The new sand from tanks 1 is also delivered to the hopper 90 as previously mentioned. The blender 6 provides continuous high speed blending of the sands and employs a mix-folding action provided by a slowly rotating paddle and it also provides controlled vibration to fluidize solids. The result is a rapid dispersion from one solid phase into another. Good mixing efficiency is provided by the gentle action and the discharged mix contains the same ratio of materials as supplied at the inlet. The paddle employed in the mixer is shown in FIG. 1 and includes a rotatable auger and paddle assembly 93.

The mixed sand moves through the blender by gravity and consequently retention time and mixing time are maximum for any given feed rate. The mixed material then passes through the outlet of the blender 96 which includes a direction delivery spout 97, 98 which can convey the mixed material to either the vibratory conveyor 99 or 100, respectively, for delivery to a fluid bed cooler FBC-2 or to the coating station CS, respectively.

The mixed sand that passes through the fluid bed cooler FBC-2 is conveyed by the transporter T through conduit 105 and into a storage bin 107 which will then contain first grades of reclaimed and clean sand.

Heating-Coating-Cooling

The mixed or blended sand which is diverted by diverter 98 is conveyed to the coating station CS. More specifically, it is delivered by conveyor 100 to the hopper 110 and then into a heater 112 of the coating station.

The heater 112 receives its heat from heat that has been reclaimed from the furnace 24. This is accomplished by a heat exchanger 113 that is connected by air conduit 113*a* with the furnace and by conduit 113*b* which connects the heat exchanger with the hot coater 114. Thus, the heat from the furnace is utilized without permitting the contaminated air from entering and contaminating the hot coater 114. Heat exchangers of the air-to-air type or water jacket types, among others may be used, provided they deliver clean heat to the coater. The sand which is to be coated is then heated to the proper temperature of about 450° F. for the subsequent bond coating process. The sand then passes to the hot coater 114 which applies or mixes a hot coating shell of bond to the sand. Slowly revolving augers 115 having mixing paddles are used for this coating process.

The shell coating sand then passes to a screen cooler 116 where the coated product is completely cooled and is then delivered via the transporter T and conduit 118 to the surge hopper 120 which accommodates varying rates of flow in the systems. The sand then passes through the fluid bed cooler FBC-3 of the type previously described and the transporter T then conveys it via conduit 124 to the storage bin 126 where it is available for reuse as a reclaimed and shell coated sand.

I claim:

1. A process of reclaiming used foundry sand containing magnetic and non-metallic foreign material comprising the steps of reducing the size of the used foundry sand by crushing, separating the magnetic material and at least some of the foreign non-metallic material from the crushed sand, passing the crushed sand through a furnace and heating the crushed sand to about 1400° F.

to expand the sand and to contract the sand to thereby separate foreign material from the sand, cooling the heated sand to about 400°–500° F. classifying the cooled sand as to size in an air sweep classifier, further cooling sufficiently coarse agglomerated classified sand and then passing said further cooled coarse sand to a pneumatic reclaimer and scrubbing the coarse sand to further reduce agglomeration and separate further foreign material therefrom, passing the further reduced sand back into said air sweep classifier for size classification thereof, and conveying said further reduced and classified sand to a storage bin.

2. The process of claim 1 including the step of combining the reclaimed sand with new sand for reuse as clean new sand.

3. A process of reclaiming used foundry sand containing magnetic and non-metallic foreign material comprising the steps of: reducing the size of the used foundry sand by means of lump crushing, separating the magnetic material from the reduced sand, separating non-metallic material from the reduced sand by passing the sand through a fluid bed separator, passing the crushed sand through a furnace and heating the crushed sand to about 1400° F. to cause expansion and rapid contraction, quenching the heated sand and cooling the heated sand to a temperature of about 500° F., passing the cooled sand through an air sweep classifier so as to classify the sand as to size and separate dust therefrom, and whereby sufficiently reduced in size sand is passed to a storage bin, passing the balance of the remaining coarse classified sand to a fluid bed cooler further cooling said coarse sand to about 300° F., passing said further cooled coarse sand to a pneumatic reclaimer and scrubbing the coarse sand to further reduce the size of the coarse sand and separate further foreign material therefrom, passing said further reduced coarse sand back into said air sweep classifier for size classification thereof, and conveying said further reduced in size coarse sand to said storage bins.

4. The process of claim 3 including the step of combining the reclaimed sand with new sand for reuse as clean new sand.

5. A process of reclaiming used foundry sand containing magnetic and non-metallic foreign material comprising the steps of: reducing the size of the used foundry sand by means of crushing, separating the magnetic material from the crushed sand, separating at least a portion of said non-metallic material from the crushed sand by passing it through a fluid bed separator, passing the crushed sand through a thermal conveyor furnace and utilizing foreign material in the sand to at least partially heat the sand, thereby heating the sand to about 1400° F. to cause the sand grains to expand and then rapidly contract, thereby stabilizing the said grain size, quenching the heated sand and thereby cooling the sand to a temperature of about 500° F., passing the cooled sand through an air sweep multiple screen classifier so as to classify the sand as to size and also separate dust therefrom, and whereby sufficiently reduce classified sand of various size is passed to a plurality of different size grade storage bins, and passing the remaining coarse agglomerated classified sand to a fluid bed cooler and further cooling said coarse sand to about 300° F., passing said coarse sand to a pneumatic reclaimer and scrubbing the coarse sand to further reduce its size and separate foreign material therefrom, passing said further reduced sand back into said air sweep classifier for size classification thereof, conveying said further reduced and classified sand to said storage bins.

6. The process of claim 5 including the step of combining the reclaimed sand with new sand for reuse as clean new sand.

* * * * *